US006828519B2

(12) United States Patent
Bui et al.

(10) Patent No.: US 6,828,519 B2
(45) Date of Patent: Dec. 7, 2004

(54) DOORBELL ASSEMBLY WITH HIDDEN FASTENER

(75) Inventors: Jeanette Bui, Irvine, CA (US); Michael Winardi, Fullerton, CA (US)

(73) Assignee: Newfry LLC, Newark, DE (US)

( * ) Notice: Subject to any disclaimer, the term of this patent is extended or adjusted under 35 U.S.C. 154(b) by 288 days.

(21) Appl. No.: 10/290,922

(22) Filed: Nov. 8, 2002

(65) Prior Publication Data

US 2003/0094358 A1 May 22, 2003

Related U.S. Application Data

(60) Provisional application No. 60/337,006, filed on Nov. 8, 2001.

(51) Int. Cl.[7] ..... H01H 9/00

(52) U.S. Cl. ..... 200/341; 200/293; 200/294; 200/295; 174/53

(58) Field of Search ..... 174/48, 49, 53–58, 174/66, 67; 200/293–297, 341; 361/600, 627, 628, 631, 632, 673, 679, 829, 832, 837

(56) References Cited

U.S. PATENT DOCUMENTS

| | | | | |
|---|---|---|---|---|
| 973,817 A | | 10/1910 | Russell | |
| 2,536,494 A | | 1/1951 | Erkkila | |
| 3,084,962 A | | 4/1963 | Feuerbacher | |
| 3,151,350 A | | 10/1964 | Manion | |
| 3,586,796 A | * | 6/1971 | Simovits et al. | 200/6 BA |
| 4,840,584 A | * | 6/1989 | Cox | 439/538 |
| 4,857,669 A | * | 8/1989 | Kitamura et al. | 174/53 |
| 5,803,238 A | * | 9/1998 | Roza | 200/332.1 |
| 5,881,864 A | * | 3/1999 | Shelhorse | 200/296 |
| 6,146,159 A | * | 11/2000 | Brunker | 439/135 |

* cited by examiner

*Primary Examiner*—Michael A. Friedhofer
(74) *Attorney, Agent, or Firm*—Richard J. Veltman; John D. Del Ponti

(57) ABSTRACT

A doorbell assembly with hidden fasteners includes a doorbell cover, a bracket for supporting the doorbell cover and a button assembly. The bracket includes a first set of resilient fingers for engaging the button assembly and a second set of resilient fingers for engaging the doorbell cover.

4 Claims, 2 Drawing Sheets

DOORBELL ASSEMBLY WITH HIDDEN FASTENER

This application claims priority to Provisional Application No. 60/337,006, filed Nov. 8, 2001.

The present invention relates to doorbells and particularly to doorbell escutcheons and their method of attachment. More particularly, the invention relates to the use of hidden fasteners to attach a door bell escutcheon.

BACKGROUND OF THE INVENTION

Due to the weight of a solid brass doorbell cover, it is customary to secure the unit using screws which are exposed from the outside. However, for aesthetic reasons, it is desirable to conceal the fasteners. Unfortunately, the use of concealed fasteners typically provides an unreliable attachment or requires the use of special tools to install or remove the doorbell cover. Manufacturers and consumers alike would welcome a doorbell cover attached with hidden fasteners that is reliable and can be installed and/or removed without using special tools.

SUMMARY OF THE INVENTION

A doorbell assembly with hidden fasteners includes a doorbell cover, a bracket for supporting the doorbell cover and a button assembly. The cover and bracket include central apertures that are operatively disposed in registry to receive the button assembly. The bracket includes a first set of resilient fingers for engaging the button assembly and retaining the button assembly in the central apertures and a second set of resilient fingers for engaging internal flanges formed on the inside of the doorbell cover.

Other features and advantages will become apparent from the following description when viewed in accordance with the accompanying drawings and appended claims.

DETAILED DESCRIPTION OF THE DRAWINGS

Figure 1:
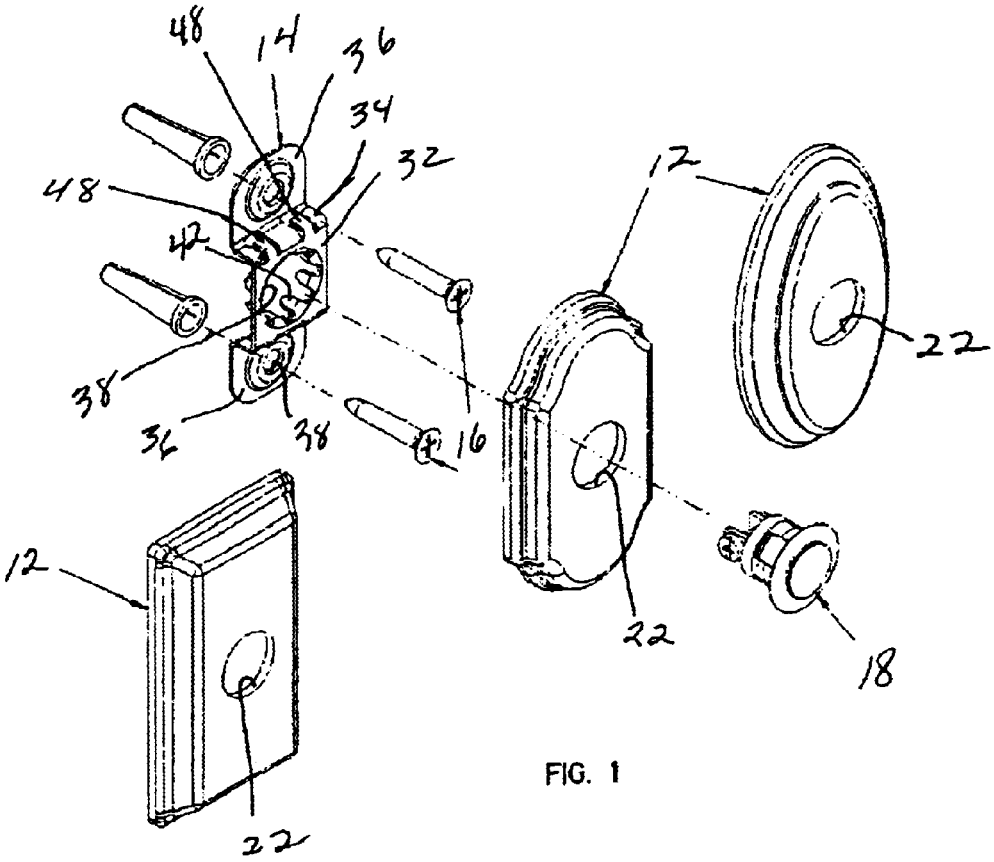
FIG. 1 is an exploded view of a doorbell cover and hidden attachment mechanism.
Figure 2:
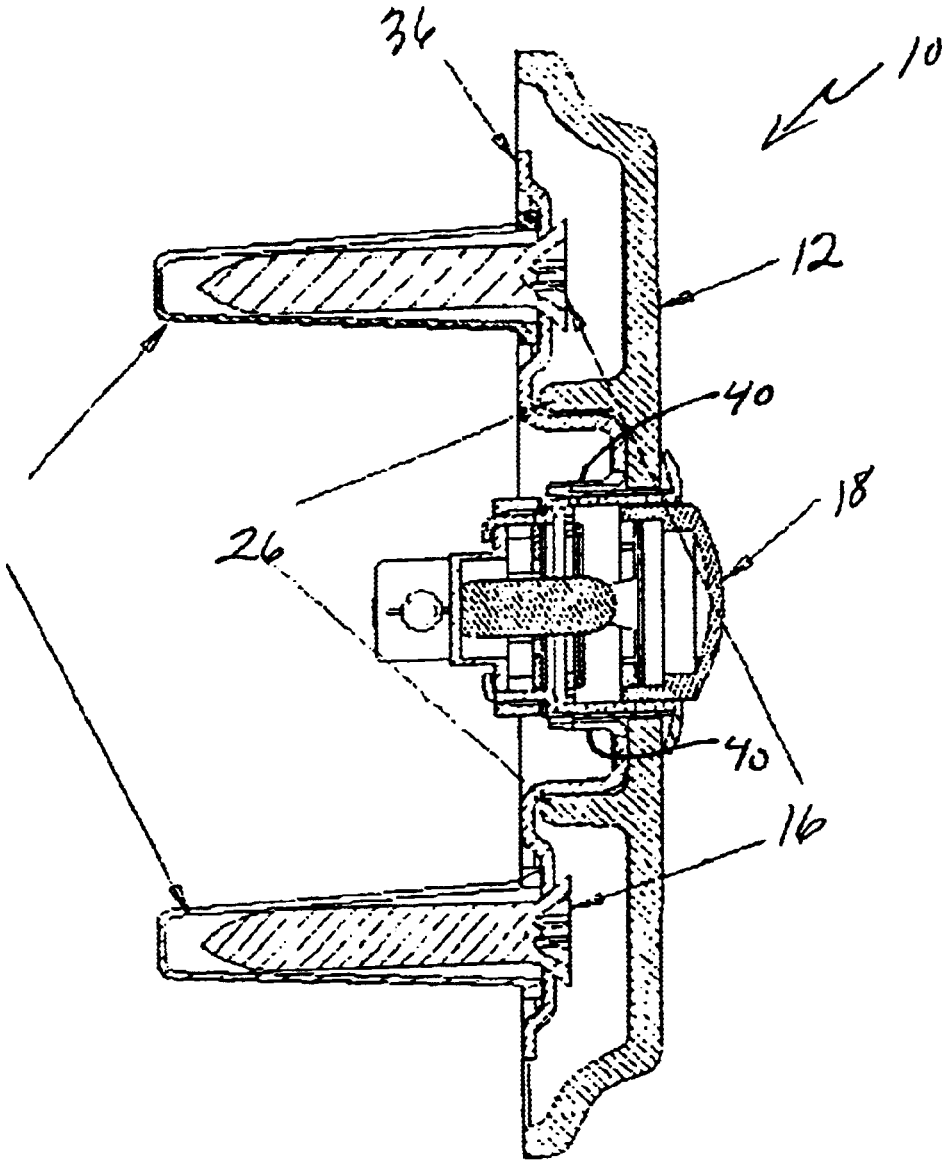
FIG. 2 is a section view taken through an assembled doorbell cover with hidden attachment mechanism.

A doorbell assembly 10 to be attached to a wall by hidden fasteners is illustrated in FIGS. 1–2. The assembly 10 includes a doorbell cover 12, a bracket 14, a pair of fasteners 16, and a button assembly 18. The doorbell cover 12 includes a central aperture 22 for receiving the button assembly 18 and a pair of flanges 26 extending transversely across the inside of the cover 12.

The bracket 14 includes a central wall portion 32, a pair of side walls 34 extending orthogonally therefrom, and a pair of flanges 36 extending outwardly from the side walls 34 parallel to the central wall portion 32. The central wall portion 32 includes a central aperture 38 and a skirt 40 depending from the edge of the central aperture 38. The skirt 40 includes a plurality of fingers 42 projecting slightly radially inwardly to frictionally engage the button assembly 24. Each side wall 34 includes a pair of fingers 48 that project slightly outwardly from the central wall portion 32 to frictionally engage the flanges 26. Each flange 36 includes a screw-receiving aperture 38.

To install the doorbell assembly 10, a user drills two holes in a mounting wall and screws the bracket 14 to the mounting wall with the fasteners 16. The user then pushes the doorbell cover 12 onto the bracket 14, with the fingers 48 on each side wall 34 engaging the internal flanges 26, 28 on the cover 12. The user then connects the appropriate wiring to the button assembly 18 and inserts the button assembly 18 into the central aperture 22 in the cover 12, with the fingers 42 engaging the button assembly 18.

The above-described embodiments, of course, are not to be construed as limiting the breadth of the present invention. Modifications and other alternative constructions will be apparent which are within the spirit and scope of the invention as defined in the appended claims.

What is claimed is:

1. A doorbell assembly comprising:

a cover having an aperture;

a button assembly disposed in the aperture; and a bracket having a first plurality of fingers for engaging the cover and a second plurality of fingers for engaging the button assembly.

2. The assembly of claim 1 wherein the bracket includes a first portion having a central aperture, a skirt depending from an edge of the central aperture and including the second plurality of fingers.

3. The assembly of claim 2 wherein the bracket further includes a pair of sidewalls depending from the first portion and including the first plurality of fingers.

4. A doorbell assembly comprising:

a cover having a central aperture and a plurality of flanges disposed on an inside surface of the cover;

a button assembly disposed in the central aperture; and a bracket having a central aperture operatively aligned with the central aperture in the cover, a first plurality of fingers extending from an edge of the central aperture for engaging the button assembly, and a second plurality of fingers disposed to engage the plurality of flanges.

* * * * *